US005453559A

United States Patent [19]

Phillips et al.

[11] Patent Number: 5,453,559

[45] Date of Patent: Sep. 26, 1995

[54] HYBRID CONDENSATION-ABSORPTION OLEFIN RECOVERY

[75] Inventors: Christopher L. Phillips, Houston; Vijender K. Verma, Sugar Land, both of Tex.

[73] Assignee: The M. W. Kellogg Company, Houston, Tex.

[21] Appl. No.: 221,616

[22] Filed: Apr. 1, 1994

[51] Int. Cl.[6] ..... C07C 7/00; F25J 3/02

[52] U.S. Cl. ..... 585/809; 95/42; 62/24

[58] Field of Search ..... 585/809; 95/42; 62/24

[56] References Cited

U.S. PATENT DOCUMENTS

| | | | |
|---|---|---|---|
| 4,743,282 | 5/1982 | Mehra | 62/17 |
| 4,832,718 | 5/1989 | Mehra | 62/17 |
| 5,019,143 | 5/1991 | Mehra | 62/17 |
| 5,220,097 | 6/1993 | Lam et al. | 585/809 |

OTHER PUBLICATIONS

Lam et al., "Advanced Ethylene Process," A.I.Ch.E. Spring National Meeting, Mar. 31, 1993, Houston, Tex.

*Primary Examiner*—Anthony McFarlane

*Assistant Examiner*—Nhat D. Phan

*Attorney, Agent, or Firm*—The M. W. Kelloggg Company

[57] ABSTRACT

A hybrid condensation-absorption process and unit is disclosed for the recovery of olefins. A mixed-component stream containing hydrogen, methane and olefins is compressed and refrigerated against propylene refrigerant to partially condense the stream. The condensate is stripped of volatile components and fed to a fractionation unit such as a deethanizer. The volatile components stripped from the condensate and the non-condensed vapor from the mixed-component stream are fed to a solvent absorption unit to remove olefins which are absorbed in the solvent. The olefins-rich solvent is regenerated to recover olefins and lean solvent. The lean solvent is recirculated to the absorption unit. The olefins recovered from regeneration of the solvent are fed to the fractionation unit along with the pre-stripped condensate. Vapor from the absorption unit is cryogenically processed to recover a crude hydrogen product, a fuel gas product and residual olefins which can be recycled to the absorption unit. The hybrid process eliminates the need for low temperature (ethylene) refrigeration equipment, generally required by conventional condensation-based olefins recovery technology, and substantially reduces the solvent recirculation rate to the absorption unit and eliminates hydrogen expansion as compared to conventional absorption-based technology.

10 Claims, 6 Drawing Sheets

HYBRID CONDENSATION-ABSORPTION OLEFIN RECOVERY

FIELD OF THE INVENTION

The present invention relates to the recovery of olefins in an olefins plant, and more particularly to a hybrid technique using both condensation and solvent absorption to recover olefins.

BACKGROUND OF THE INVENTION

Ethylene is a ubiquitous building block in the manufacture of a wide variety of chemical and plastic products. Ethylene is typically produced industrially by pyrolysis of hydrocarbons in a furnace in the presence of steam. The furnace effluent stream comprising a range of components is typically cleaned up, dried to remove water, compressed and passed to an olefins recovery section to condense the ethylene and other condensable heavy end components (ethane, propylene, propane, etc.). The condensed stream is then distilled to remove the light ends (methane and hydrogen) and fractionated to separate ethylene from the heavy ends.

Compositional range of the furnace effluent stream depends on several factors including the type of hydrocarbon feedstock used. A representative composition of the effluent of a furnace employing three different hydrocarbon feedstocks and operated to maximize ethylene formation is given in Table 1.

TABLE 1

| | Effluent Composition (mole %) Furnace Feedstock | | |
|---|---|---|---|
| Component | Ethane | Propane | Naphtha |
| $H_2$ | 35.9 | 20.5 | 15.8 |
| $CH_4$ | 6.5 | 27.8 | 26.5 |
| $C_2H_4$ | 34.3 | 32.0 | 33.6 |
| $C_2H_6$+ | 23.3 | 19.7 | 24.1 |

The condensation of ethylene from the hydrogen and methane components requires considerable refrigeration which makes up a significant portion of the process energy requirements. Where hydrogen, methane and ethylene are recovered by condensation, refrigerants typically include propylene as well as ethylene and sometimes methane. Ethylene and methane refrigeration are generally colder than propylene refrigeration, and have higher energy requirements and require more expensive materials of construction such as, for example, nickel alloys or stainless steel.

Recently, solvent-based olefins recovery has attracted attention as a potential alternative to condensation recovery. For example, Lam et al., "Advanced Ethylene Process", A.I.Ch.E. Spring National Meeting, Session No. 18, Mar. 31, 1993, claims that solvent-based olefins recovery can reduce energy and capital requirements, including such benefits as elimination of the ethylene refrigeration machine, ethylene refrigeration chillers and stainless steel/alloy piping associated with this equipment.

Olefin recovery using absorption in a solvent is described in Lam et al. mentioned above, as well as U.S. Pat. No. 5,220,097 to Lam et al. and U.S. Pat. Nos. 5,019,143 to Mehrta and 4,743,282 and 4,832,718 to Mehra, all of which are hereby incorporated herein by reference. Briefly, methane and hydrogen are separated from an olefin stream by contacting the olefin stream in an absorber with a solvent capable of absorbing the olefins. The olefins then are recovered from the solvent by thermal regeneration, typically in a reboiled regeneration column to vaporize the olefins which are condensed overhead for further processing and purification. The hydrogen and methane are recovered as an overhead vapor from the absorption unit, and can be further processed to obtain purified hydrogen and methane streams by cryogenic fractionation and/or methane extraction with a solvent.

A recently disclosed embodiment of the absorption method commercially offered is described in Lam et al. Briefly, a front-end heat-pumped deethanizer or depropanizer and a selective acetylene hydrogenation system are combined with a solvent absorption system to recover the ethylene product. Using a full range naphtha feedstock with a front-end depropanizer system, the pyrolysis furnace effluent is indirectly quenched in transfer-line exchangers and then directly quenched in an oil quench tower and a water quench tower with conventional heat recovery. The cooled water quench tower overhead stream typically is compressed in three stages to an optimum pressure primarily governed by the operating pressure of the front-end depropanizer. At the cracked gas compressor third stage discharge, acid gases are removed by caustic scrubbing. The acid gas-free cracked gas is then dried before entering the fractionation section of the plant. A low pressure debutanizing stripper may be located in the compression train to remove pentane and heavier components from the cracked gas.

In the Lam et al. process, the front-end heat-pumped depropanizer allows fractionation at low pressure and condensation at high pressure. Fouling is said to be minimized when the depropanizer is operated at low pressure. The energy for heat pumping of the depropanizer is provided by the fourth stage of the cracked gas compressor. At the compressor discharge, acetylene is selectively hydrogenated to ethylene in the front-end reactor system. In addition, about 80% of the methyl acetylene and about 20% of the propadiene are said to be selectively converted to propylene.

The acetylene-free propane and lighter portion of the cracked gas in the Lam et al. solvent absorption system leaves the reactor and is dried in the secondary drier to remove trace quantities of moisture, leaves the depropanizer reflux drum and is fed to a reboiled absorber column. The ethylene and heavier components are absorbed by the solvent while methane and lighter components, together with some ethylene, leave the top of the absorber. This overhead stream is then fed to a small demethanizer section where essentially all of the ethylene and heavier components are recovered. The demethanizer section is autorefrigerated by means of an expander, and no external refrigeration is said to be required. The rich solvent is fed to a solvent regenerator where the demethanized $C_2$'s and $C_3$'s are recovered as overhead product. The lean solvent is returned to the absorber after heat recovery.

The $C_2$'s and $C_3$'s are further separated in a conventional deethanizer to produce $C_2$ and $C_3$ fractions. These two fractions are then processed in their respective superfractionators to produce polymer grade ethylene and propylene products. Ethane and propane bottom products are said to be recycled and cracked to extinction in the pyrolysis furnace. Refrigeration for the entire ethylene recovery process is said to be supplied by a propylene refrigeration compressor only and no ethylene or methane refrigeration is said to be required. The hydrogen recovery section can also include a demethanizer for separating components heavier than methane from the liquid methane stream and forming a methane vapor stream for expansion in the expansion zone. Compared to state-of-the-art conventional demethanizer-first condensation-based olefins recovery process, the above-described Mehra process still uses more compression power and has a higher low pressure steam requirement. Also, the Mehra process uses a high solvent circulation rate. In order to achieve about 99.8% recovery of ethylene without the use of ethylene refrigeration, 75–80% of the hydrogen product must be expanded to fuel gas pressure to provide refrigeration in the demethanizer area.

Accordingly, there is a need for an absorption-based olefins recovery process which has reduced energy requirements, eliminates the need for ethylene refrigeration, and reduces the solvent circulation rate for absorption.

SUMMARY OF THE INVENTION

The present invention is directed to a hybridized olefins recovery process which uses both condensation and solvent absorption. The feed to the olefins recovery unit from the front-end deethanizer and/or depropanizer heat pumped circuit is further cooled, e.g. against propylene refrigerant, ethane recycle, etc., to partially condense the feed stream. The non-condensed vapor then is fed to the solvent absorption unit. Out of the liquid condensed, a portion is returned to the deethanizer and/or depropanizer as reflux, while the remaining liquid is sent forward to a demethanizer prestripper to remove methane and lighter gases. The bottoms of the prestripper, essentially a mixture of $C_2$'s and/or $C_3$'s, is then sent as a second feed to an olefins fractionation unit (a deethanizer, for example) along with any olefins obtained from thermal regeneration of the solvent for the absorption unit. The non-condensed vapor from the condensing step, and the vapor from the prestripping step, are treated in the absorption unit to recover most of the remaining $C_2$'s and/or $C_3$'s. However, since much more of the $C_2$ and/or $C_3$ material has already been condensed and sent to the prestripper, this greatly reduces the solvent circulation rate in the absorption unit and the associated energy requirements in the recovery of $C_2$'s and/or $C_3$'s in the solvent regeneration unit.

Accordingly, the present invention provides a hybrid condensation-absorption process for separating and recovering olefins from a cracking furnace effluent. The process includes the steps of:

(a) refrigerating a mixed-component stream containing olefins, methane and hydrogen to form mixed-component condensate and vapor streams;

(b) fractionating the condensate stream from step (a) to obtain an overhead stream comprising hydrogen, methane and olefins, and a bottoms product stream comprising olefins essentially free of hydrogen and methane;

(c) contacting the vapor stream from step (a) and the overhead stream from step (b) with an olefins-lean solvent to absorb olefins into the solvent and form a vapor stream of hydrogen and methane substantially free of olefins, and an olefins-rich solvent stream;

(d) regenerating the olefins-rich solvent stream to form the olefins-lean solvent stream for recycle to step (c) and an olefins stream essentially free of solvent; and (e) fractionating the olefin streams from steps (b) and (d) to obtain one or more purified olefin product streams.

In this process, the refrigerant in step (a) can be primary propylene refrigerant, preferably sufficient to condense a major portion of the mixed-component stream in step (a). The refrigeration step (a) preferably occurs at an elevated pressure, for example, above 2.5 MPa, more preferably above 3.5 MPa, to maximize the condensate stream formed in step (a).

In one preferred embodiment, the solvent contact/absorption step (c) includes the following steps:

(1) contacting the vapor stream from step (a) with a first portion of the olefins-lean solvent from step (d) to form a first methane vapor stream essentially free of olefins and a first intermediate olefins-enriched solvent stream;

(2) contacting the overhead stream from step (b) with a second portion of the lean solvent from step (d) to form a second methane vapor stream essentially free of olefins and a second intermediate olefins-enriched solvent stream; and (3) stripping methane from the intermediate solvent streams from steps (1) and (2) to form the olefins-rich solvent stream for thermal regeneration in step (d).

Steps 2 and 3 of step (c) preferably include the steps of:

(A) feeding the overhead stream from step (b) and the first intermediate solvent stream from step (1) to a mid-column feed zone of a solvent stripping column having an olefins absorption zone above the feed zone and a methane stripping zone below the feed zone;

(B) feeding the second portion of the lean solvent to the absorption zone;

(C) heating the stripping zone; and (D) recovering the olefins-rich solvent stream from the stripping zone for regeneration in step (d).

In an alternate embodiment, the condensate stream fractionation step (b) includes the steps of:

(A) feeding the condensate stream from step (a) to a feed zone of a prestripping column having a solvent absorption zone receiving vapor from the feed zone, and a heated methane stripping zone below the feed zone in fluid communication therewith; and (B) recovering the bottoms product stream comprising olefins essentially free of hydrocarbon and methane from said stripping zone;

the solvent contact/absorption step (2) includes the steps of:

(C) feeding the second portion of the lean solvent from step (d) to an upper portion of the solvent absorption zone of the prestripping column;

(D) recovering the second methane vapor stream overhead from the solvent absorption zone of the prestripper column; and (E) recovering the second intermediate solvent stream from a lower portion of the absorption zone of the prestripping column; and the methane stripping step (3) includes the steps of:

(F) feeding the intermediate solvent streams from steps (1) and (E) to a feed zone of a solvent stripping column having an olefins absorption zone above the feed zone of the solvent stripping column, and a heated methane stripping zone below the feed zone of the solvent stripping column;

(G) feeding a third portion of the lean solvent from step (d) to an upper portion of the absorption zone of the solvent stripping column;

(H) recovering a third methane vapor stream overhead from the absorption zone of the solvent stripping column; and (I) recovering the olefins-rich solvent stream from a lower portion of the stripping zone of the solvent stripping column for regeneration in step (d).

The process preferably uses propane or propylene refrigerant where needed, and avoids the use of ethylene refrigeration. For example, the solvent contacting/ absorption step (1) is preferably effected in a propylene-refrigerated absorption zone, and the stripping step (3) in a stripping zone which may be partially heated by subcooling propylene refrigerant.

In another aspect, the present invention provides a hybrid condensation-absorption unit for the separation and recovery of olefins from a cracking furnace effluent. The unit includes a condenser for refrigerating and partially condensing a mixed olefins stream which comprises a mixture of hydrogen, methane, olefins and other hydrocarbons. A separator is provided for receiving the refrigerated stream from the mixed-olefins condenser and separating it into a non-condensed vapor stream and a liquid stream. The unit includes a prestripper column for fractionating the liquid stream from the separator into an overhead stream comprising hydrogen, methane and olefins and a bottoms product stream comprising olefins essentially free of methane. An absorption unit is provided for contacting the vapor stream from the mixed olefins separator and the overhead stream from the prestripper column with a solvent, which absorbs the olefins and forms a hydrogen-methane vapor stream, essentially free of olefins, and an olefins-rich solvent stream. The hybrid unit includes a regenerator column for regenerating the olefins-rich solvent stream from the absorption unit which yields an olefins stream, essentially free of methane and solvent, which can be recovered overhead, and an olefins-lean solvent stream which can be recovered as a bottoms product. The hybrid unit includes a line for recycling the lean solvent stream from the regenerator column to the absorption unit. A fractionation unit can be provided for separating the olefin stream from the regenerator column and the bottoms product stream from the prestripper column into one or more purified olefin products.

The hybrid unit preferably employs a refrigeration system using propylene refrigerant, for example, to refrigerate the mixed-olefins condenser. The propylene refrigerant can also be passed via an appropriate line in heat exchange with the absorption unit to cool a solvent absorption zone. The mixed olefins condenser and separator are preferably operable at a relatively high pressure, for example, above about 2.0 MPa, more preferably above about 3.5 MPa.

The hybrid condensation-absorption unit, in one preferred embodiment, includes an absorber for contacting at least the vapor stream from the mixed olefins separator with the solvent. A line is provided for transferring olefins-enriched solvent from the absorber to a feed zone of a solvent stripper which has an absorption zone and a heated stripping zone, above and below the feed zone, respectively. Another line is provided for introducing lean solvent to the absorption zone of the solvent stripper, and another for passing the overhead methane stream from the prestripper column to the feed zone of the solvent stripper, preferably below the rich solvent transfer line from the absorber. The unit also includes a line from the stripping zone of the solvent stripper to a feed zone of the regenerator column.

As an alternative preferred embodiment, the hybrid condensation-absorption unit includes an absorber for contacting the vapor stream from the mixed olefins separator with the solvent, and a line for olefins-enriched solvent from the absorber to a feed zone of a solvent stripper having an absorption zone and a heated stripping zone, above and below the feed zone, respectively. A line is provided for introducing lean solvent into the absorption zone of the solvent stripper. A solvent absorption zone is disposed above a feed zone in the prestripper column for receiving the overhead methane stream from the feed zone, contacting the stream with solvent and forming a methane stream essentially free of olefins. A line is provided for lean solvent to the solvent absorption zone of the prestripper column. A return line is provided for olefins-enriched solvent, from a solvent recovery stage of the solvent absorption zone of the prestripper column, to the feed zone of the solvent stripper. Another line is provided for introducing olefins-rich solvent essentially free of methane, from the stripping zone of the solvent stripper, to a feed zone of the regenerator column.

The fractionation unit generally includes a deethanizer and/or an ethylene-ethane splitter, and can also include a propylene-propane splitter.

When a depropanizer-first scheme is used in the hybrid unit, a depropanizer is provided for supplying an overhead vapor fraction as the mixed olefins stream to the mixed-olefins condenser, wherein the mixed olefins stream is essentially free of butane and heavier hydrocarbons. A line is provided for refluxing a portion of the liquid stream from the mixed-olefins separator to the depropanizer. In this case, the feeds to the fractionation unit preferably go to a deethanizer, overheads from the deethanizer to an ethylene-ethane splitter, and bottoms from the deethanizer to a propylene-propane splitter.

Generally, lines in the hybrid condensation-absorption unit are provided for introducing the bottoms product stream from the prestripper column and the overhead stream from the regenerator column to a feed zone of the deethanizer.

When a deethanizer-first scheme is used in the hybrid unit, the deethanizer supplies $C_2$ and lighter components, generally free of $C_3$ and heavier components, to the condenser. A portion of the condensate is used for refluxing the deethanizer, and the rest is sent to the prestripper as with the depropanizer-first scheme. The bottoms from the prestripper column are sent to an ethylene-ethane splitter with the olefins recovered from the solvent regenerator column.

The hybrid condensation-absorption olefin-recovery unit can also include a hydrogen recovery section. The hydrogen recovery section can be operated to produce a hydrogen vapor stream at relatively high pressure, i.e., without expansion of the hydrogen product, and using a very small olefins separation drum; for example, a two-equilibrium-stage vessel which does not require any reboiling or overhead condensation. The hydrogen recovery section includes a heat exchange zone for cryogenically cooling hydrogen-methane vapor streams, including the hydrogen-methane vapor stream from the absorption unit. The heat exchange zone generally may include one or more cross-exchangers. The hydrogen recovery section also has a condensate separation zone for receiving one or more cooled streams from the heat exchange zone, recovering one or more liquid methane streams of reduced hydrogen content, and recovering one or more vapor streams of enhanced hydrogen content. The hydrogen recovery section also has an expansion zone for expanding at least a part of one of the liquid methane streams to provide refrigeration for the heat exchange zone. In this manner, the crude hydrogen vapor stream (approximately 80 volume percent hydrogen) from the condensate separation zone is not expanded and remains at essentially the same pressure as the methane vapor stream from the absorption unit.

Figure 1:
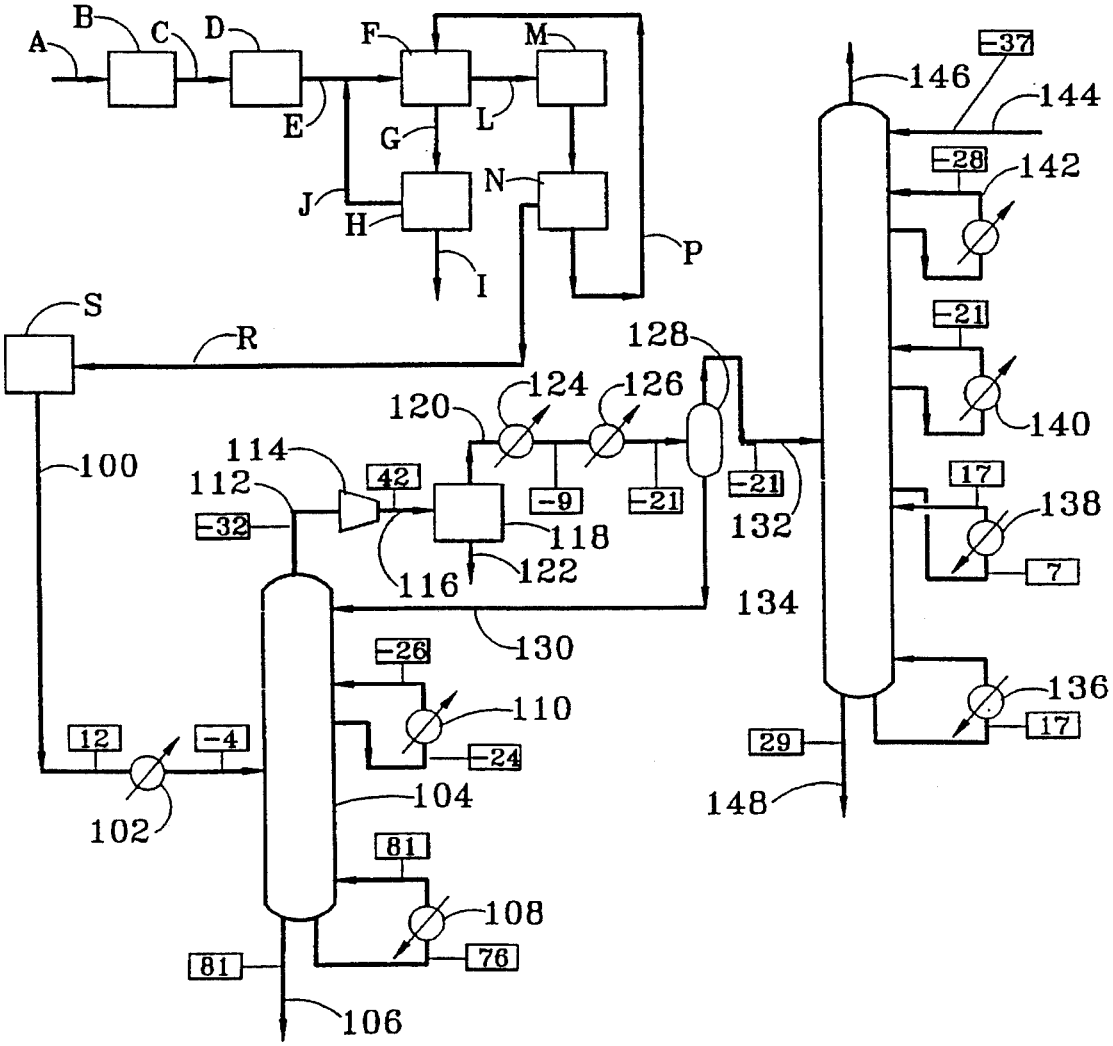
FIG. 1 (PRIOR ART)
FIG. 1 is a process schematic illustrating typical absorption of olefins in a manner similar to the prior art Lam et al. disclosure. Feedstock stream A is pyrolyzed in cracking furnace B to form an effluent stream C which is quenched in quench unit D. The quench tower overhead stream E (0.13 MPa; 350° C.) is passed to a three-stage process gas compression unit F. Liquids condensed by cooling the compressor discharge streams are passed in stream G to low pressure stripper unit H. Heavy-end condensate is obtained from the low pressure stripper unit H through line I, and lighter components are recycled via line J to stream E. Stream L from the third stage compressor discharge is passed through caustic wash unit M to remove acid gases and then to cooling separation unit N to produce a liquid stream P which is recycled to the compressor area F, and a vapor stream R, which is passed through drier S. Feed stream 100 (131,650 kg/hr; 0.94 MPa; 12° C.) from the drier S is fed through cooler 102 ($1.55\times10^6$ kcal/hr) into depropanizer 104. A bottoms product stream 106 (20,935 kg/hr; 0.97 MPa; 80° C.) from the depropanizer 104 comprises butane and heavier components. The depropanizer 104 is reboiled via heat exchanger 108 ($3.02\times10^6$ kcal/hr) and cooled via intermediate condenser 110 ($1.0\times10^6$ kcal/hr). Depropanizer overhead stream 112 is compressed in fourth-stage compressor 114 (6191 kW). Compressor discharge stream 116 (3.32 MPa; 42° C.) is passed through conventional acetylene converter unit 118 to produce a propane and lighter components stream 120 which is essentially free of acetylene and propadiene. Any green oil produced can be withdrawn through line 122. Stream 120 is cooled in chillers 124 ($3.03\times10^6$ kcal/hr) and 126 ($1.50\times10^6$ kcal/hr) and fed to separator 128. Condensate from separator 128 is refluxed via line 130 (33,245 kg/hr) to depropanizer 104. The amount of cooling of the stream 120 by chillers 124 and 126 is governed by the amount of reflux needed for the depropanizer 104. Vapor stream 132 (111,054 kg/hr; 3.07 MPa; −10° C.) from the separator 128 is fed to an absorber 134 which is heated below the feed tray by reboiler 136 ($5.46\times10^6$ kcal/hr) and intermediate reboiler 138 ($5.0\times10^6$ kcal/hr), and cooled above the feed tray by intermediate condensers 140 ($2.5\times10^6$ kcal/hr) and 142 ($2.75\times10^6$ kcal/hr). Lean solvent stream 144 (196,351 kg/hr; −37° C.) is introduced to the top of the absorber 134. As the solvent passes down through the absorber 134, components heavier than methane are absorbed into the solvent while lighter components, such as methane and hydrogen are not absorbed and pass overhead into stream 146 (30,559 kg/hr; 3.03 MPa; −26° C.). Olefins-enriched solvent is obtained as a bottoms stream 148 (276,638 kg/hr; 3.06 MPa;49° C.).

($10.66\times10^6$ kcal/hr) to partially condense the olefins. Heat exchanger 318 generally is supplied with propylene refrigerant as the coolant and/or various process streams for heat integration. The partially condensed stream 316 is fed to a vapor-liquid separator drum 322. The drum 322 produces a vapor stream 324 (50,344 kg/hr; 3.56 MPa; −40° C.) overhead and a liquid stream 326 as bottoms. A portion of the liquid is refluxed via line 308 to the depropanizer 302, as previously mentioned, and the remainder (64,699 kg/hr) is fed to prestripping column 328. The prestripping column 328 is heated by means of reboiler 332 ($2.88\times10^6$ kcal/hr) to strip methane and more volatile compounds overhead and obtain a bottoms stream 334 (50,468 kg/hr) which is essentially free of methane and hydrogen. Overhead vapor stream 336 (14,231 kg/hr) from the prestripping column 328 includes the methane stripped in the stripping column 328, but usually contains a minor amount of olefins and heavier components. The liquid stream 334 from the methane prestripping column 328 is fed to a fractionation unit 338 (see FIG. 5). The vapor streams 324 and 336 are fed to an absorption unit 330. The stream 324 is fed to a lower section of absorber 340. Lean solvent is introduced to an upper section of the absorber 340 via line 342 (105,028 kg/hr). As the solvent passes downwardly in the absorber 340, it contacts upcoming vapor and selectively absorbs $C_2$'s and $C_3$'s. Stream 344 (15,802 kg/hr) obtained overhead is essentially free of $C_2$'s and $C_3$'s and can be processed for recovery of hydrogen, fuel gas, or the like (see FIG. 6). The absorber 340 is cooled by intermediate condensers 346 and 348 ($0.9\times10^6$ kcal/hr total). A bottoms stream 350 from the absorber 340 comprises olefins-rich solvent, which is fed to a feed zone of a solvent stripper column 352 along with the vapor stream 336 from the prestripping column 328. Lean solvent is supplied via line 354 (68,763 kg/hr) to an upper end of an absorption zone in the solvent stripper column 352 above the feed zone. The solvent stripper column 352 is heated by reboiler 358 and intermediate reboiler 360. An overhead vapor stream 362 (9,783 kg/hr) is essentially free of ethylene and heavier components, and can be further processed in the hydrogen/tailgas recovery section (see FIG. 6). An olefins-enriched solvent stream 364 (207,922 kg/hr) is taken as a bottoms product from the solvent stripper 352.

Figure 4:
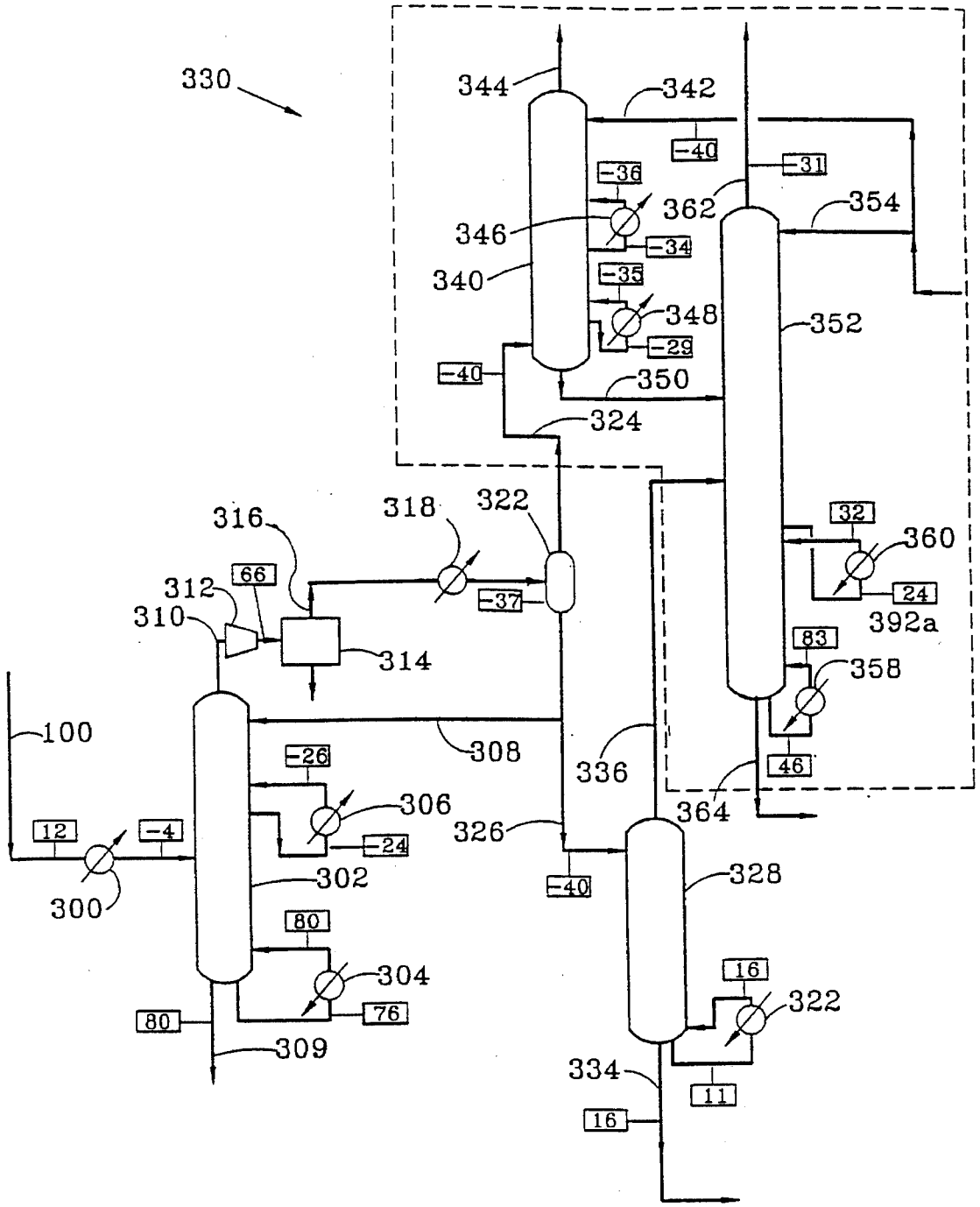
FIG. 4 is a process schematic illustrating one embodiment of partial condensation and solvent absorption of the hybrid condensation-absorption olefins recovery process and equipment in accordance with the present invention. The raw olefins stream 100 which generally has the same composition, properties and flow rate as in FIG. 1, is cooled in heat exchanger 300 and fed to depropanizer 302. The depropanizer 302 is operated in a manner similar to that for the depropanizer 104, heated by reboiler 304, cooled by intermediate condenser 306, and refluxed via line 308. Overhead vapor stream 310 (143,190 kg/hr) is compressed by compressor 312 and processed in an acetylene converter 314 similar to FIG. 1. The stream 316, essentially free of acetylene and propadiene, is cooled in heat exchanger 318
Figure 5:
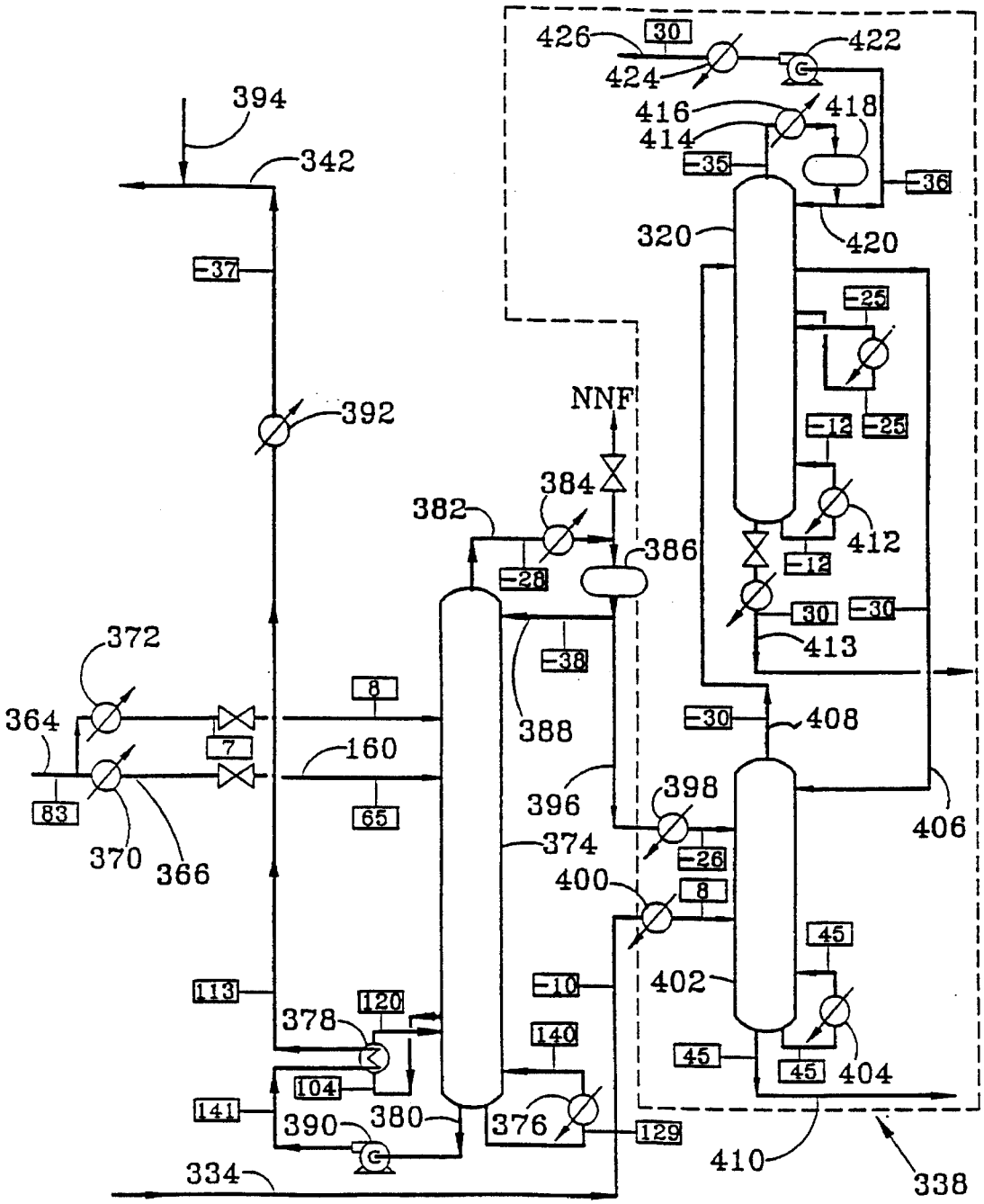

FIG. 5 is a process schematic illustrating solvent regeneration and olefin fractionation for use with the process of FIG. 4 according to the present invention. The stream 364 from the solvent stripper (see FIG. 4) is split into streams 366 and 368, cooled in heat exchangers 370 and 372, and introduced to a mid-column feed zone of a solvent regenerator column 374. The regenerator column 374 is heated by reboiler 376 ($6.87\times10^6$ kcal/hr) and intermediate reboiler 378 to strip the olefins from the solvent to obtain a bottoms product comprising regenerated or lean solvent via line 380 (173,376 kg/hr). An olefins vapor stream 382 is obtained overhead, and is essentially free of methane and lighter components and solvent. The vapor stream 382 is condensed in heat exchanger 384 ($4.21\times10^6$ kcal/hr) and the condensate is collected in drum 386. A portion of the liquid from the drum 386 is refluxed via line 388 to an upper end of an absorption zone of the solvent regenerator column 374, above the feed zone, to enhance the purity of the stream 382. Lean solvent is pumped via pump 390, cooled in intermediate reboiler 378 as previously mentioned and heat exchanger 392 ($13.2\times10^6$ kcal/hr), combined with recycle stream 394 (834 kg/hr) from the tailgas recovery section (see FIG. 6), and supplied to the absorber column 340 and the solvent stripper column 352 as previously mentioned (see FIG. 4). The fractionation unit 338 receives liquid streams 334 and 396 from the stripping column 328 and drum 386, respectively. The streams 396 and 334 are heated in heat exchangers 398 and 400 ($4.9\times10^6$ kcal/hr total) and introduced to a feed zone in deethanizer column 402. The deethanizer 402 is heated by reboiler 404 ($2.32\times10^6$ kcal/hr) and cooled by reflux introduced via line 406 (31,500 kg/hr). $C_2$'s are recovered overhead via line 408 (93,326 kg/hr) and introduced to a feed zone in the ethylene-ethane splitter 320. The $C_3$ product from the deethanizer 402 is obtained as a bottoms product via line 410 (23,188 kg/hr). The reflux stream 406 is preferably obtained as a side-draw from the ethylene-ethane splitter 320 adjacent the feed zone. The splitter column 320 is heated by reboiler 412 ($4.89\times10^6$ kcal/hr) and intermediate reboiler **318*b* as previously mentioned. Overhead vapor stream 414 is cooled in condenser 416 ($17.2\times10^6$ kcal/hr) and condensate is collected in drum 418. Ethylene is refluxed from drum 418 to an upper end of an absorption zone of the splitter column 320 above the feed zone via line 420. Ethylene product is pumped from the drum 418 via pump 422, optionally heated in heat exchanger 424 ($2.32\times10^6$ kcal/hr) for recovery of refrigeration, and passed into ethylene product line 426** (52,693 kg/hr).

Figure 6:
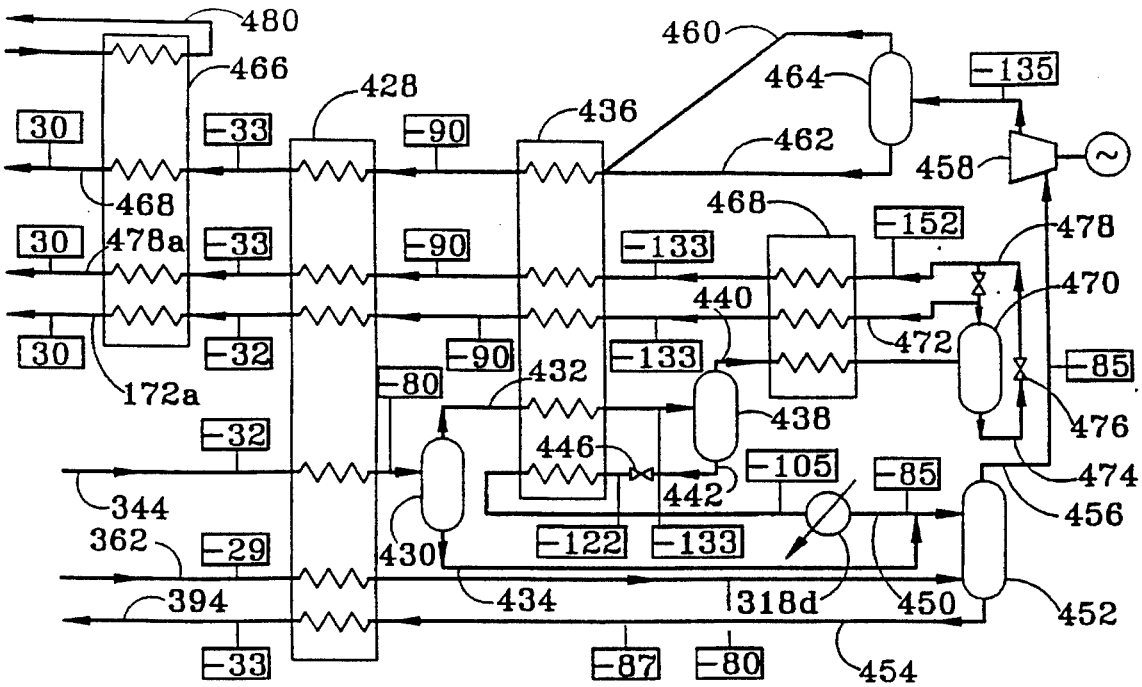

FIG. 6 is a process schematic of a hydrogen/tailgas recovery section which can be used with the condensation/absorption process of FIGS. 4–5, in accordance with the present invention. A first cross-exchanger 428 cools the streams 344 and 362 from the absorber 340 and solvent stripper 352, respectively (see FIG. 4). The stream 344 is cooled, fed to a vapor-liquid separator drum 430 and separated into vapor stream 432 and liquid stream 434. The vapor stream 432 is cooled in the second cross-exchanger 436 and divided in vapor-liquid separator drum 438 into vapor stream 440 and liquid stream 442. The liquid stream 442 is expanded across valve 446, passed through the cross-exchanger 436 and heat exchanger **318*d* as the cooling medium and into line 450, where it is combined with liquid stream 434 and fed to a relatively small tray tower 452. The cooled stream 362 is also supplied as a lower feed to the separation drum 452. Liquid bottoms product from the separation drum 452 is recovered via line 454, passed through the cross-exchanger 428 as a cooling medium and into line 394 to the solvent recycle line 342 as previously mentioned (see FIG. 5). An overhead vapor stream 456 from the separation drum 452 is expanded in a turbine expander 458, separated into vapor line 460 and liquid line 462 via drum 464, passed through the cross-exchangers 436 and 428 as a cooling medium, and then through cross-exchanger 466 into line 468 for recovery as a high pressure fuel gas product. The vapor stream 440 from the drum 438 is cooled in cross-exchanger 468 and divided in drum 470 into overhead vapor stream 472 (3,234 kg/hr) and liquid stream 474 (7,276 kg/hr). The liquid stream 474 is flashed across valve 476 into line 478. Vapor streams 472 and 478 are passed through the cross-exchangers 468, 436, 428 and 466, as cooling media, and recovered as a crude hydrogen product (approximately 80–90 mole percent hydrogen) and a low pressure fuel gas product in lines 472*a* and 478*a*, respectively. The cross-exchanger 466 is used to recover refrigeration by cooling propylene refrigerant circulated therethrough via line 480**.

Figure 7:
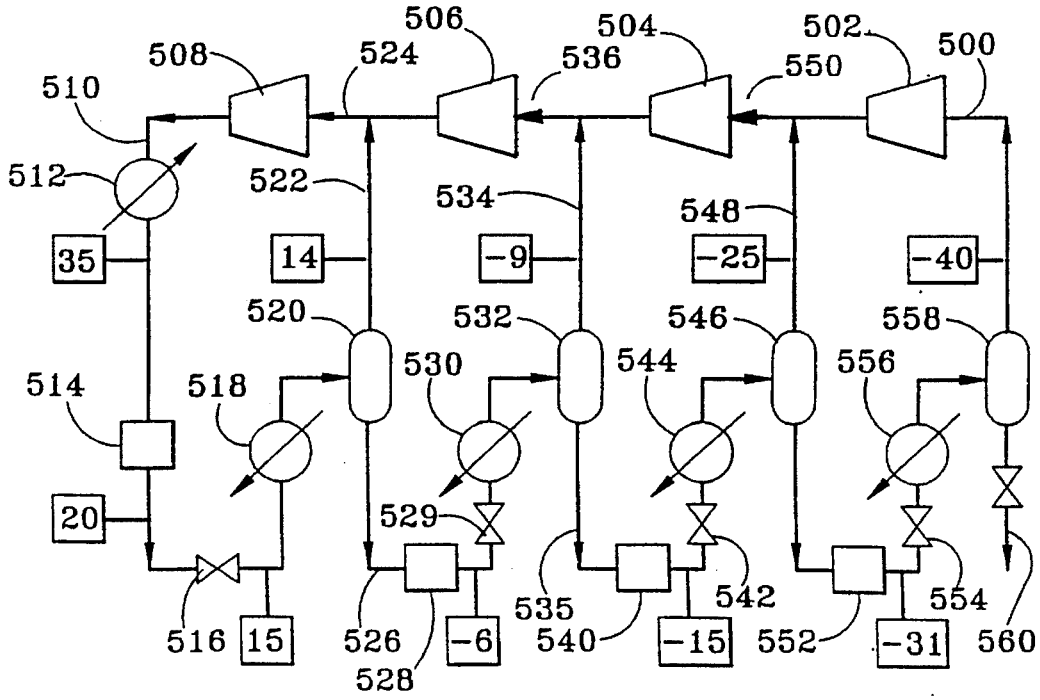

FIG. 7 is a process schematic of a propylene refrigeration system which can be used in conjunction with the process illustrated in FIGS. 4–6 according to the present invention. Propylene refrigerant from suction line 500 is compressed in series in compressors 502, 504, 506 and 508 from a pressure of about 0.134 MPa in line 500 to a pressure of about 1.62 MPa in discharge line 510. The propylene in line 510 is passed through a heat exchanger 512 where it is cooled in heat exchange with cooling water, for example. The propylene in line 510 is further cooled in process heat exchange zone 514 and expanded across valve 516 to about 0.854 MPa, partially vaporized in process heat exchange zone 518 and fed to drum 520. Vapor from drum 520 is passed via line 522 into fourth-stage compressor 508 suction line 524. Liquid stream 526 from the drum 520 is cooled in process heat exchange zone 528, expanded across valve 529 to about 0.43 MPa, partially vaporized in process heat exchange zone 530 and fed to drum 532. Vapor from the drum 532 passes through line 534 into the third-stage compressor 506 suction line 536. Liquid from the drum 532 is passed via line 538, cooled in process heat exchange zone 540, flashed across valve 542 to about 0.24 MPa, partially vaporized in process heat exchange zone 544, and fed to drum 546. Vapor from the drum 546 is passed via line 548, into second-stage compressor 504 suction line 550. Liquid from the drum 546 is passed through process heat exchange zone 552, expanded across valve 554 to about 0.134 MPa, heated in process heat exchange zone 556, passed through knock-out drum 558, and into the first-stage compressor 502 suction line 500. Material collected in the drum 558 can be periodically removed via blow down line 560.

DESCRIPTION OF THE INVENTION

According to the present invention, an olefin/methane stream is chilled and partially condensed. The condensate is stripped of volatiles and sent to a fractionation unit. Non-condensed vapor from the mixed-component stream and volatiles stripped from the condensate are passed through a solvent absorption unit. In this manner, the absorption unit is smaller and requires less solvent circulation than if the entire mixed-component stream was fed to the absorption unit. Also, less refrigeration is needed when compared to a condensation-based olefins recovery scheme.

The present invention is generally applicable to separating olefins from more volatile components such as methane and hydrogen, such as in an olefins plant processing the conditioned effluent from a pyrolysis or cracking furnace. However, the present invention is applicable generally to the separation and recovery of hydrocarbons, such as ethane, ethylene, propane and propylene, from a mixture thereof with volatile components, such as methane and/or hydrogen. Conventional conditioning can include quenching, heat recovery, compression, heavy component ($C_4$ and/or $C_5$ and heavier components) removal, acid gas removal, dehydration or water removal, acetylene and diene conversion and/or removal, and the like.

The mixed-component stream is chilled and partially condensed. The present technology is particularly attractive when propylene refrigerant is employed for all refrigeration requirements which are not satisfied by recovering refrigeration from process streams such as ethane recycle, feed/effluent heat exchange, etc. Propylene refrigerant is typically chilled in several stages to about −40° C. for low temperature refrigeration, but this is not a limitation of the present invention. In the present invention, it is preferred that the chilling of the mixed-component stream against propylene (or propane) refrigerant to be maximized to condense olefins therefrom. In general, the more olefin condensed in the initial cooling, the less vapor that needs to be processed in the absorption unit, and the smaller the absorption unit and solvent circulation rate will be. Usually, cooling of the mixed-olefin stream to the coldest temperature practical with the propylene refrigerant (typically about −35° to about −40° C.) is satisfactory.

Cooling of the mixed-component feed stream is effected in conventional heat exchange equipment (chillers). The cooled stream is then separated in a conventional vapor-liquid separator, such as, for example, a single-stage vessel or drum which allows liquid to be withdrawn as a bottoms product draw and vapor as an overhead product draw. The cooling and vapor-liquid separation is preferably carried out at a relatively high pressure to facilitate the maximum condensate formation at the available refrigeration level. The pressure must be subcritical, of course, to allow vapor-liquid equilibrium, but a pressure above about 2.5 MPa is preferred, and especially about 3.5 MPa.

If desired, a portion of the condensate from the vapor-liquid separator can, and preferably is, refluxed to the top of the depropanizer (or deethanizer). The remaining condensate is processed in a stripping unit to remove volatiles such as methane and hydrogen. The stripping unit or prestripper is generally a fractional distillation column with conventional internals, i.e. trays, packing elements, flow distributors, and the like. The prestripper is preferably heated, for example, by a reboiler, to facilitate stripping of the volatile components in a stripping section between a feed zone and bottoms product recovery zone. The prestripper can include a rectification section above the feed zone, but it is preferred, in one embodiment, to obtain an overhead vapor stream adjacent the feed zone to avoid the need for reflux.

The vapor from the mixed-component vapor-liquid separator and the overhead vapor stream from the prestripper are processed in a solvent absorption/regeneration unit to obtain volatile products (hydrogen, methane, carbon monoxide and/or mixtures thereof) and an olefin product free of volatiles. The absorption unit can be any suitable apparatus for contacting the vapor streams with a solvent to absorb the olefins in the solvent and obtain a vapor essentially free of olefins. Representative examples of absorption units are packed and trayed columns well known in this field. In general, the solvent/vapor contact removes most of the olefins from the vapor so that the vapor product comprises hydrogen, methane and a small amount of olefin, generally a trace amount, and the solvent product is enriched in olefins. The absorption unit preferably contains an enriched solvent stripping zone to remove methane and hydrogen from the olefin-enriched solvent product.

The vapor feed to the absorption unit can optionally be passed first through a hydrogen rejection membrane separation unit. The membrane separator can reject a substantial portion of the hydrogen in the vapor streams fed to the absorption unit. The membrane separator unit is preferably installed early in the process, for example on line 324 (FIG. 4) after the initial refrigeration (with propylene refrigerant which increases the hydrogen partial pressure in the non-condensed vapor) to reduce the amount of hydrogen processed through the absorption unit. The membrane separator can be installed at other locations in the present olefins recovery process, but a location following the condensate separation drum 322 is preferred because partial pressure of hydrogen is higher and overall flow is lower since a large portion of $C_2$'s and heavier components have already been condensed and removed. Hydrogen rejection produces a hydrogen-lean stream which can be more readily processed by solvent absorption to remove the olefins. The vapor fed to the membrane separator is generally heated to suitable membrane operating conditions, preferably heated initially in a cross-exchanger by an exchange of heat first against a hydrogen-lean impermeate stream and then in a heater by an exchange of heat against a suitable heating medium such as, for example, steam. A hydrogen-rich permeate stream is obtained as one product. Gas which does not permeate the membrane separator exits for further processing for recovery of olefins in the absorption unit. Further information regarding the membrane hydrogen separation unit is described in commonly assigned U.S. Ser. No. 08/222,205 "Olefin Recovery Method," filed of even date herewith by Verma et al., which is hereby incorporated herein by reference.

The solvent used in the absorption unit can be any suitable solvent known for absorbing ethylene and heavier components from methane and lighter components, such as, for example, the solvents disclosed in the Mehra and Mehrta patents mentioned above, which are hereby incorporated herein by reference. Suitable solvents typically include benzene and mixtures of pentane and benzene.

The absorption unit can include one or a plurality of solvent/vapor contacting devices or columns. The vapor streams from the separator and the prestripper can be fed to the same solvent absorption column, but are preferably fed to respective columns. The first absorption column receives the vapor from the vapor-liquid separator in a feed zone and lean solvent in an absorption zone above the feed zone. The absorption zone of the first absorption column is preferably cooled with propylene refrigerant to facilitate absorption of olefins in the solvent, minimize solvent circulation, and minimize olefin leakage overhead. A temperature of –37° C. is suitable in most cases, but a higher temperature could be used if a higher solvent circulation rate and a higher reboiler duty are tolerable.

The first absorption column is operated at a pressure which is governed primarily by the pressure at which it is desired to deliver the crude hydrogen product. In general, the highest feasible pressure is desirable since this imparts less reliance on the expander operation for the cryogenic core balancing, maximizes feed to the prestripper, and minimizes solvent circulation requirements.

The vapor from the prestripper is preferably fed to a separate absorption zone for contact with the lean solvent to absorb residual olefins therefrom and provide a methane-rich second feed stream to the hydrogen/tailgas recovery section. The second absorption zone is preferably operated with the same pressure and temperature considerations as the first absorption column. The second absorption column reduces the overall lean solvent circulation rate and/or reduces the olefins leakage into the hydrogen/tailgas recovery section. In addition, use of the second absorption column substantially avoids the need to expand hydrogen to balance the refrigeration requirements of the hydrogen/tail gas recovery unit.

In one preferred embodiment, the second absorption zone is disposed above a feed zone in a solvent stripping column. In this embodiment, the olefins-enriched solvent from the first absorption column is introduced in the feed zone of the solvent stripping column, preferably above a feed point for the vapor from the prestripper column. The solvent stripping column has a stripping zone below the feed zone. The stripping zone is heated to reduce the volatiles content of the enriched solvent obtained as a bottoms product from the solvent stripping column.

In an alternate embodiment, the second absorption zone can be installed in the prestripper column above the feed zone thereof. In this embodiment, the vapor from the prestripper passes through the absorption zone immediately above the feed zone. Lean solvent is introduced at the top of the second absorption zone and passes downwardly in contact with the rising vapor. The olefins-enriched solvent is withdrawn from this second absorption zone and passed through a stripping zone in a solvent stripping column as mentioned above. In this embodiment, the enriched solvent from the first absorption column is also introduced to the feed zone in the solvent stripping column. A third lean solvent stream is fed to the top of the solvent stripping column. An overheads vapor product is obtained from the stripping column, and the stripping column is reboiled as mentioned above, but the stripping column in this embodiment can be operated at a relatively lower pressure and temperature than the absorption column and the prestripping column for more energy efficiency.

In the regenerator column, the olefins-enriched solvent is processed, e.g. heated and/or depressurized, to vaporize the olefins which are condensed at an overhead condenser, and produce a regenerated solvent lean in olefins for recirculation to the absorption unit. The regenerator pressure is generally desired to be as low as possible, but should allow for olefins condensation against refrigerant, preferably propylene refrigerant at –40° C. The temperature and pressure of the regenerator column should also allow the use of low pressure steam for reboiling. In general, reduced pressure and temperature tends to minimize reboiler fouling.

Olefins obtained from the regenerator column and bottoms liquid from the prestripping column can be fractionated into one or more olefins products, e.g. ethylene and/or propylene. Generally, where a front-end depropanizer is used, the olefins streams will contain ethylene and propylene with some ethane and propane byproducts. However, where a front-end deethanizer is employed, the olefins products will comprise primarily ethylene and ethane since the propylene and propane are obtained in the bottoms from the deethanizer. When a front-end depropanizer is used, the fractionation unit includes a deethanizer and an ethylene-ethane splitter. The two olefin feeds from the prestripper column and the regenerator column are fed to the feed zone of a deethanizer, which is operated in a generally conventional manner well known to those skilled in the art. The availability of two feeds to the deethanizer substantially decreases the deethanizer condenser and reboiler duties and allows better recuperation of refrigeration from the deethanizer feed. The ethylene-ethane mixture obtained overhead from the deethanizer is in turn introduced into the feed zone of the ethylene-ethane splitter.

In general, the ethylene-ethane splitter is operated at a pressure as low as possible which still allows condensation of overheads against low level propylene refrigerant. In one preferred embodiment, a side-draw from the ethylene-ethane splitter is used as reflux for the deethanizer to reduce propylene refrigerant load for the deethanizer condenser. It is in some cases possible to eliminate the operation of the deethanizer condenser during normal operation, with a reduction in the ethylene-ethane splitter reboil duty; however, a start-up condenser, reflux drum and reflux pump are usually used during start up and process upsets.

The hydrogen/tail-gas recovery section of the present process preferably provides a hydrogen product at relatively high pressure, preferably above about 2.5 MPa and especially above about 3 MPa, and at a relatively high purity, preferably above about 70 mole percent hydrogen and especially above about 85 mole percent hydrogen. In addition, balancing of the cryogenic hydrogen recovery section design to obtain this high pressure, high purity hydrogen product does not require hydrogen expansion and significantly simplifies and reduces the size of the demethanizer, or eliminates the demethanizer altogether. Also, more hydrogen can be exported as product. The vapor stream from the solvent stripping column is chilled in a cross-exchanger and fed to a small olefins separation drum, preferably without reflux or reboiling. The vapor from the absorption column is cooled and condensed in cascaded cross-exchangers, and liquid condensed therefrom is also fed to the separation drum. If desired, solvent can be injected into the feed streams from the absorption column and the solvent stripping column to help reduce $C_2$ and $C_3$ losses in the cryogenic core. Cooling in the cross-exchangers is obtained by expanding the condensed liquids from the absorption column feed and the fuel gas product from the separation drum. In this manner, the hydrogen recovery/tail-gas processing section obtains a high pressure hydrogen product, and a fuel gas (methane) product at a relatively lower pressure suitable for conventional fuel gas systems.

The refrigeration system is preferably operated on propylene refrigerant, but could also use other conventional refrigerants, such as, for example, halogenated hydrocarbons, propane, ethane, etc. In an olefins plant, propylene is commonly used since it is readily available, but this is not a limitation on the present invention. The propylene refrigeration system used in the present process is conventional and well known to those in the art. Also, it is possible to change the number of propylene refrigerant compressors, e.g. 3 or 5 could be used as well as 4, depending on the process parameters which determine the optimum number in a particular plant according to basic engineering principles.

The invention is illustrated by way of the following examples.

EXAMPLES

Figure 2:
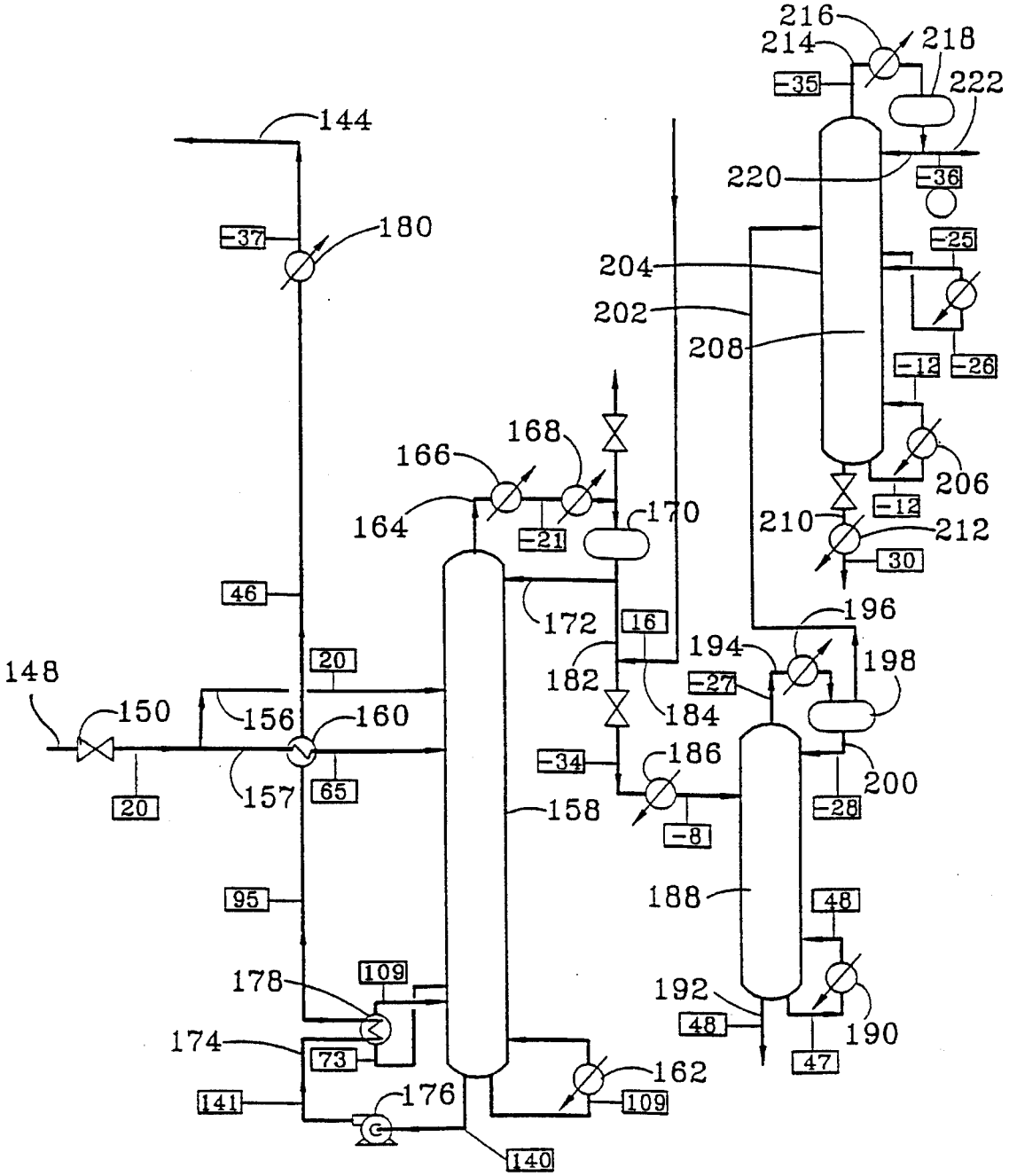
FIG.2 (PRIOR ART)
FIG. 2 is a process schematic illustrating typical solvent regeneration and olefins fractionation similar to the Lam et al. process in conjunction with FIG. 1. The olefins-enriched solvent in line 148 is divided into streams 156 and 157. Stream 156 is introduced to solvent regenerator 158 at an upper intermediate feed tray, and stream 157 is heated in exchanger 160 ($5.0\times10^6$ kcal/hr) and introduced to a mid-column feed tray in the regenerator 158. Regenerator 158 is heated by means of reboiler 162 ($13.27\times10^6$ kcal/hr) to drive off the more volatile olefins which are collected overhead in stream 164, condensed in condensers 166 and 168 ($10.3\times10^6$ kcal/hr), and collected in condensate drum 170. Condensate is refluxed to the top of the regenerator 158 via line 172 (−37° C.; 1.2 MPa). Lean solvent is withdrawn from the regenerator 158, pumped through line 174 via pump 176, cooled in heat exchangers 178 ($5.0\times10^6$ kcal/hr), 160 and 180 ($12.0\times10^6$ kcal/hr, respectively), and passed through line 144 for recycle to the absorber 134 (see FIG. 1). The exchanger 178 is an intermediate reboiler on the regenerator 158, and heat exchanger 160 heats the feed stream 157. Heat exchangers 180*a–e* comprise various process streams and/or propylene refrigeration streams. The recovered olefins from condensate drum 170 are passed through line 182 (80,287 kg/hr) along with any demethanizer bottoms in stream 184 (4,728 kg/hr) (see FIG. 3), through feed preheater 186 ($4.9\times10^6$ kcal/hr), and into a feed tray in deethanizer 188. Deethanizer 188 is heated via reboiler 190 ($4.55\times10^6$ kcal/hr) to produce a $C_3$ stream 192 (23,188 kg/hr) as a bottoms product. The overheads stream 194 is cooled in partial condenser 196 ($3.55\times10^6$ kcal/hr) and passed to condensate drum 198. Condensate stream 200 is refluxed to the top of the deethanizer 188, and vapor stream 202 is fed to ethylene-ethane splitter 204. The splitter 204 is heated by reboiler 206 ($5.64\times10^6$ kcal/hr) and intermediate reboiler 208 ($6.0\times10^6$ kcal/hr). Ethane product stream 210 (9,141 kg/hr) is recovered as a bottoms product from the splitter 204 and can be heated for recovery of refrigeration in heat exchanger 212 ($0.99\times10^6$ kcal/hr). Ethylene is obtained in overhead line 214, condensed in condenser 216 ($16.7\times10^6$ kcal/hr) and recovered in drum 218. Ethylene is refluxed to the splitter 204 in line 220 and withdrawn as a product in line 222 (52,626 kg/hr).
Figure 3:
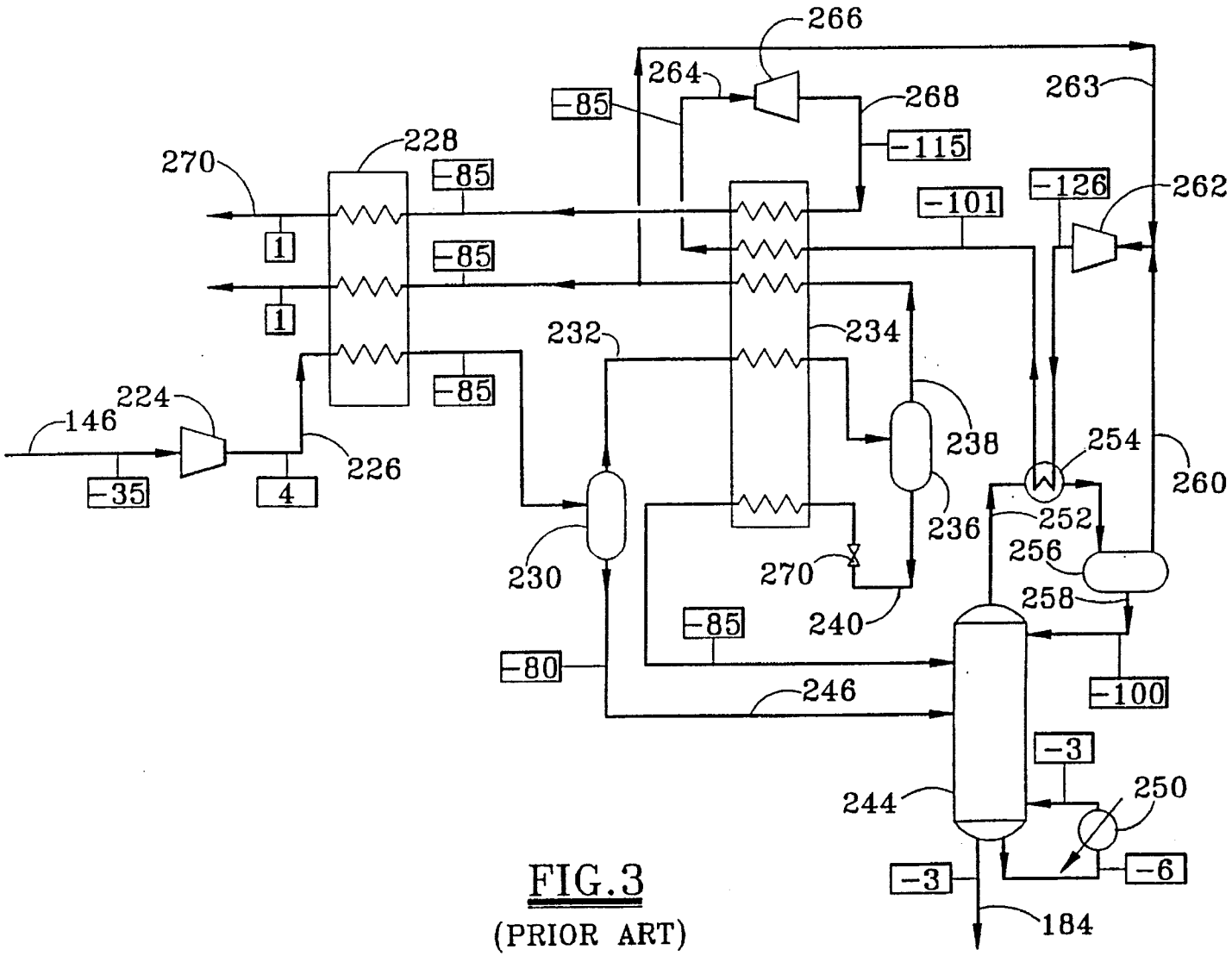
FIG. 3 (PRIOR ART)
FIG. 3 is a process schematic of a hydrogen/tailgas recovery section which can be used in connection with the olefins recovery process of FIGS. 1 and 2 according to the prior art. The methane and hydrogen stream 146 from the absorber 134 (see FIG. 1) is compressed in compressor 224 (optional), passed through line 226, cooled in cross-exchanger 228, and fed to drum 230 where it is separated into vapor and liquid phases. Vapor stream 232 is cooled in cross-exchanger 234 and fed to drum 236 where it is separated into vapor and liquid phases. Vapor stream 238 is passed through cross-exchangers 234 and 228 to cool streams 226 and 232 as previously mentioned. Liquid stream 240 from the drum 236 is expanded across valve 242, passed through cross-exchanger 234 to help cool stream 232, and introduced as an upper mid-column feed to demethanizer 244. Liquid stream 246 from the drum 230 is fed to the demethanizer 244 as a mid-column feed. The demethanizer 244 is heated via reboiler 250 for refrigeration recovery, and bottoms product stream 184 is recycled to the deethanizer 188 (see FIG. 2) as previously mentioned. Overheads stream 252 from the demethanizer 244 is cooled in exchanger 254 ($0.44\times10^6$ kcal/hr) and condensate is collected in drum 256. Liquid from drum 256 is refluxed via line 258 to the top of the demethanizer 244. Vapor from the drum 256 is fed via line 260 to turbine expander 262, along with all or part of stream 263 from the partially warmed hydrogen product stream 238. Expanded vapor from the turbine 262 passes through heat exchanger 254 as previously mentioned and cross-exchanger 234. Partially heated stream 264 is expanded in turbine expander 266 and the resulting expanded stream 268 is passed through cross-exchanger 234 and cross-exchanger 228 to stream 270 suitable for use as a fuel gas.

One embodiment of the present invention is illustrated by way of reference to FIGS. 4–7, and comparison with the absorption scheme of FIGS. 1–3, wherein like numbers are used to indicate like parts. The data reflected are based on a plant producing 52.7 metric tons per year of ethylene from a naphtha feedstock; with a propylene/ethylene product weight ratio of 0.40; operating at U.S. Gulf Coast conditions (32° C. cooling water supply); with the ethylene product at 40° C. and 3 MPa; using a three-stage process gas compressor (unit F) with interstage pressures selected to give similar discharge temperatures (80°–85° C.); with the vapor drier R feed set at 12° C. and 0.96 MPa; with the depropanizer feed 100 chilled to –4° C.; with the depropanizer 104 and 302 pressures set to give an approximate bottoms 106 and 309 temperatures of 80° C.; with acetylene converters simulated to give no loss or gain of ethylene, assuming 15% of incoming acetylene is converted to green oil (as butene) and 50% of incoming methyl acetylene and propadiene is converted to propylene; with the solvent regenerator 158 and 374 pressures set to condense overhead vapor against low level propylene refrigerant (–40° C.) with the lean solvent chilled by feed/effluent exchange, process-to-process exchange and propylene refrigerant to –37° C.; with the deethanizer 188 and 402 feeds reheated to recover refrigeration; and with the ethylene-ethane splitter 204 and 320 pressures set at 1.65 MPa to allow for condensing against –40° C. propylene refrigerant. In addition, for the prior art process of FIGS. 1–3, the following assumptions were made: depropanizer 104 overhead vapor compression was set to give about 3.03 MPa at the absorber 134 so that the hydrogen product in line 238 will be available at about 3 MPa; tail gas recovery unit refrigeration needs were met by expansion of 80% of the hydrogen (versus 75% stated in Lam et al.); the absorber 134 overhead vapor was assumed to contain 5 mole percent $C_2$'s and $C_3$'s; and with the deethanizer 188 pressure set at 1.92 MPa and the $C_2$ splitter 204 intermediate reboiler 208 duty at $6\times10^6$ kcal/hr (approximately 52% of total reboil duty for the $C_2$ splitter 204).

The hybrid condensation-absorption process of FIGS. 4–7 was simulated with conventional software and compared to a simulation of the absorption-based process of FIGS. 1–3. Selected stream compositions and properties are given in Table 2 for the hybrid process of FIGS. 4–7. A comparison of the solvent and energy requirements between the Example Process (FIGS. 4–7) and the Solvent Process (FIGS. 1–3) is presented in Table 3.

A comparison of simulation results for the hybrid recovery scheme of FIGS. 4–7 with those of the solvent-only-based recovery scheme of FIGS. 1–3 shows the energy requirements are less for the hybrid process than the solvent-only-based process. See Table 3. Note the Example Process requires more process gas compression energy, but this is more than offset by lower propylene refrigeration energy requirements than the Solvent Process. Also, the Solvent Process requires expansion of 80% of the crude hydrogen product, and the energy savings of the Example Process do not reflect any crediting for elimination of the depropanizer and demethanizer reflux pumps, ethylene refrigeration lube/seal oil pumps or similar equipment in a typical condensation recovery process.

TABLE 2

| Stream (Line No. in FIGS. 4–7) | Depropanizer Feed (100) | Depropanizer Bottoms (309) | Absorber Feed (324) | Absorber Overheads (344) | Solvent Stripper Overheads (362) | Regenerator Overheads (396) | Prestripper Feed (326) | Prestripper Bottoms (334) |
|---|---|---|---|---|---|---|---|---|
| Phase | Mixed | Liquid | Vapor | Vapor | Vapor | Liquid | Liquid | Liquid |
| Temperature (°C.) | –4 | 80 | –40 | –34 | –31 | –38 | –40 | 16 |
| Pressure (MPa) | 0.93 | 0.97 | 3.58 | 3.5 | 3.50 | 1.40 | 3.5 | 3.58 |
| Primary | | | | | FLOW RATE (kg/hr) | | | |
| Components | | | | | | | | |
| $H_2$ | 1963 | 0 | 1646 | 1607 | 93 | 0 | 53 | 0 |
| CO | 76 | 0 | 68 | 63 | 13 | 0 | 8 | 0 |
| $CH_4$ | 22945 | <0.001 | 17504 | 13553 | 9388 | 3 | 5441 | 1 |

TABLE 2-continued

| | | | | | | | | |
|---|---|---|---|---|---|---|---|---|
| $C_2H_2$ | 1406 | <0.001 | 0 | 0 | 0 | 0 | 0 | 0 |
| $C_2H_4$ | 52892 | <0.001 | 21165 | 80 | 18 | 27928 | 31728 | 24868 |
| $C_2H_6$ | 7669 | <0.001 | 2766 | 17 | 8 | 3670 | 6284 | 5356 |
| $C_3H_4$ | 2202 | 167 | 57 | 9 | 4 | 73 | 766 | 732 |
| $C_3H_6$ | 20654 | 0.1 | 2228 | 199 | 95 | 2821 | 19708 | 18811 |
| $C_3H_8$ | 482 | 0.01 | 41 | 4 | 2 | 52 | 440 | 423 |
| $C_4H_6$ | 8394 | 8367 | <1 | <0.1 | <0.1 | 0 | 10 | 10 |
| $C_4H_8$ | 5415 | 5458 | 5 | 1 | 1 | <0.01 | 196 | 194 |
| $C_4H_{10}$ and heavier | 7547 | 7471 | 2 | 277 | 161 | <0.1 | 74 | 73 |
| TOTAL | 131650 | 21463 | 45482 | 15802 | 9783 | 34546 | 64699 | 50468 |

| Stream Line No. in FIGS. 4–7) | Deethanizer Bottoms (410) | Deethanizer Overheads (405) | C2 Splitter Overheads (426) | C2 Splitter Bottoms (413) | H2 Product Stream (472a) | Low Pressure Fuel Gas Product (478a) | High Pressure Fuel Gas Product (468) |
|---|---|---|---|---|---|---|---|
| Phase | Liquid | Vapor | Liquid | Liquid | Vapor | Vapor | Vapor |
| Temperature (°C.) | 45 | −30 | 30 | 30 | 30 | 30 | 30 |
| Pressure (MPa) | 1.82 | 1.78 | 10.34 | 0.793 | 3.34 | 0.345 | 0.52 |
| Primary Components | | | | FLOW RATE (kg/hr) | | | |
| $H_2$ | 0 | 0 | 0 | 0 | 1554 | 33 | 113 |
| CO | 0 | 0 | 0 | 0 | 36 | 19 | 20 |
| $CH_4$ | <0.001 | 4 | 4 | <0.001 | 1643 | 7213 | 13891 |
| $C_2H_2$ | 0 | 0 | 0 | 0 | 0 | 0 | 0 |
| $C_2H_4$ | <0.001 | 76450 | 52668 | 128 | <0.1 | 9 | 75 |
| $C_2H_6$ | 4 | 16865 | 21 | 9001 | <0.01 | 1 | 21 |
| $C_3H_4$ | 805 | <0.01 | 0 | <0.01 | <0.001 | <0.1 | 3 |
| $C_3H_6$ | 21627 | 7 | 0 | 5 | <0.001 | 1 | 11 |
| $C_3H_8$ | 475 | <0.1 | 0 | <0.1 | <0.001 | <0.1 | 2 |
| $C_4H_6$ | 10 | <0.001 | 0 | 0 | 0 | <0.001 | <0.01 |
| $C_4H_8$ | 194 | <0.001 | 0 | 0 | 0 | <0.001 | <1 |
| $C_4H_{10}$ and heavier | 73 | <0.001 | 0 | 0 | <0.001 | <0.001 | 4 |
| TOTAL | 23188 | 93326 | 52693 | 9134 | 3234 | 7276 | 14241 |

TABLE 3

Comparison of Energy and Solvent Requirements

| ITEM | Example Process (FIGS. 4–7) | Solvent Process (FIGS. 1–3) |
|---|---|---|
| Process Gas Compressors (BKW) | | |
| Stage 1 | 3582 | 3582 |
| Stage 2 | 4485 | 4485 |
| Stage 3 | 3934 | 3934 |
| Stage 4 | 6661 | 4157 |
| PGC TOTAL (BKW) | 18662 | 16158 |
| Propylene Refrigeration (BKW) | 14315 | 18284 |
| Solvent Pump (BKW) | 289 | 316 |
| Expander Credit (BKW) | −342 | 0 |
| TOTAL (BKW) | 32914 | 34758 |
| Low Pressure Steam ($10^6$ Kcal/hr) | | |
| Depropanizer | 2.4 | 2.3 |
| Solvent Stripper | 2.3 | N/A |
| Solvent Regenerator | 6.9 | 9.5 |
| TOTAL LP STEAM ($10^6$ Kcal/hr) | 11.6 | 11.8 |

TABLE 3-continued

Comparison of Energy and Solvent Requirements

| ITEM | Example Process (FIGS. 4–7) | Solvent Process (FIGS. 1–3) |
|---|---|---|
| Solvent Flow (kg/hr) | 173376 | 427286 |

The Example Process eliminates ethylene refrigeration, including the refrigeration machinery and associated stainless steel piping and equipment, eliminates hydrogen expansion, and eliminates the demethanizer. The solvent stripper 352 provides an additional feed (stream 362) to the hydrogen/tailgas recovery area, enabling hydrogen purification with no hydrogen expansion required for core balancing.

The solvent was a mixture of 66 weight percent pentane, 34 weight percent benzene. The use of this relatively light solvent reduces olefins leakage from the absorber to 0.5 weight percent, or only 0.2% total ethylene loss to the hydrogen/tailgas streams 456, 472 and 478. This results, in turn, in an ethylene recovery rate which is independent of the cryogenic hydrogen purification unit, but less refrigeration recovery from the reboiler 360. A lower regenerator 374 temperature (and hence more olefins in the regenerated solvent) or a slightly heavier solvent might be better for recovery of refrigeration, but this would increase the olefins in the absorber 340 and solvent stripper 352 overheads and require better cryogenic recovery for the same ethylene losses.

The use of an absorber feed/solvent mixer chiller and multiple feeds to the absorber 340 were found to have little positive effect on energy requirements. A higher process gas compressor third stage discharge pressure also had a negligible effect since this pressure could not be increased substantially without increasing the depropanizer 302 bottoms temperature above 85° C. A feed/effluent exchanger for the depropanizer heat pump compressor was also investigated, but the savings were only 100 kW, and thus not cost effective.

Recycle of 33,000 kg/hr of ethane from the ethylene-ethane splitter 320 bottoms for reflux to the depropanizer 104 was also evaluated. This recycle rate may be too high since the propylene refrigeration load increased by about 600 kW compared to no liquid recycle, primarily due to the loss of the deethanizer feed preheat. A smaller recycle rate of about 10,000–15,000 kg/hr might be more attractive.

Additional options within the purpose of the present invention which could result in additional savings include optimizing: the overhead olefins losses from the absorber 340 and solvent stripper 352; the side condenser duties and locations in the absorber 340 and solvent stripper 352; the solvent composition; the steam reboiler configuration; the propylene refrigeration system with respect to the number of stages (4 vs. 3) and low level temperature (e.g. −40° C. vs. −30° C.); and the like. Other possible alternatives are injecting solvent into the cryogenic core inlet stream to reduce olefins losses; using a warmer solvent for absorption; using a high- and low-pressure, two-tower depropanizer after a four-stage compressor followed by heat pump (saves about 300 kW, but adds a tower and liquid driers); and adding a solvent wash section to the top of the prestripper 328 to allow the solvent stripper 352 to be operated at a lower pressure and higher temperature.

The foregoing description of the invention is illustrative and explanatory thereof. Various changes in the materials, apparatus, and particular parts employed will occur to those skilled in the art. It is intended that all such variations within the scope and spirit of the appended claims be embraced thereby.

We claim:

1. A hybrid condensation-absorption process for separating and recovering olefins from a cracking furnace effluent, comprising the steps of:

(a) refrigerating a mixed-component stream containing hydrogen, methane and olefins to form vapor and condensate streams;

(b) fractionating the condensate stream from step (a) to obtain an overhead stream comprising hydrogen, methane and olefins and a bottoms product stream comprising olefins essentially free of hydrogen and methane;

(c) contacting the vapor stream from step (a) and the overhead stream from step (b) with an olefins-lean solvent to absorb olefins in the solvent and form a vapor stream of hydrogen and methane substantially free of olefins and an olefins-rich solvent stream;

(d) regenerating the olefins-rich solvent stream to form the olefins-lean solvent stream for recycle to step (c) and an olefins stream essentially free of solvent; and (e) fractionating the olefins streams from steps (b) and (d) to obtain one or more purified olefin product streams.

2. The process of claim 1, wherein the refrigeration in step (a) is primarily against propylene refrigerant.

3. The process of claim 1, wherein a major portion of the mixed-component stream is condensed in step (a).

4. The process of claim 1, wherein step (a) occurs at a pressure above 2.5 MPa.

5. The process of claim 1, wherein the solvent contacting step (c) comprises the steps of:

(1) contacting the vapor stream from step (a) with a first portion of the olefins-lean solvent from step (d) to form a first methane vapor stream essentially free of olefins and a first intermediate olefins-enriched solvent stream;

(2) contacting the overhead stream from step (b) with a second portion of the lean solvent from step (d) to form a second methane vapor stream essentially free of olefins and a second intermediate olefins-enriched solvent stream; and (3) stripping methane from the intermediate solvent streams to form the olefins-rich solvent stream for thermal regeneration in step (d).

6. The process of claim 5, wherein the steps (2) and (3) of step (c) comprise the steps of:

(A) feeding the overhead stream from step (b) and the first intermediate solvent stream from step (1) to a mid-column feed zone of a solvent stripping column having an absorption zone above the feed zone and a stripping zone below the feed zone;

(B) feeding the second portion of the lean solvent to the absorption zone;

(C) heating the stripping zone; and (D) recovering the olefins-rich solvent stream from the stripping zone for regeneration in step (d).

7. The process of claim 5, wherein:

step (b) comprises the steps of:

(A) feeding the condensate from step (a) to a feed zone of a prestripping column having a solvent absorption zone receiving vapor from the feed zone, and a heated stripping zone below the feed zone in fluid communication therewith; and (B) recovering the bottoms product stream from said stripping zone;

step (2) comprises the steps of:

(C) feeding the second portion of the lean solvent from step (d) to an upper portion of the solvent absorption zone of the prestripping column;

(D) recovering the second methane vapor stream overhead from the solvent absorption zone of the prestripper column; and (E) recovering the second intermediate solvent stream from a lower portion of the absorption zone of the prestripping column; and step (3) comprises the steps of:

(F) feeding the intermediate solvent streams from steps (1) and (E) to a feed zone of a solvent stripping column having an absorption zone above the feed zone of the solvent stripping column, and a heated stripping zone below the feed zone of the solvent stripping column;

(G) feeding a third portion of the lean solvent from step (d) to an upper portion of the absorption zone of the solvent stripping column;

(H) recovering a third methane vapor stream overhead from the absorption zone of the solvent stripping column; and (I) recovering the olefins-rich solvent stream from a lower portion of the stripping zone of the solvent stripping column for regeneration in step (d).

8. The process of claim 5, wherein the contacting step (1) is effected in a propylene-refrigerated absorption zone.

9. The process of claim 5, wherein the stripping step (3) is effected in a stripping zone at least partially heated by cooling propylene refrigerant.

10. A method for expanding the production capacity of an olefins recovery plant wherein a mixture of olefins, methane and hydrogen is cooled against propylene refrigerant to condense a portion of the olefins and produce an intermediate vapor stream, and the intermediate vapor stream is cooled against ethylene refrigerant to condense out substantially all of the remaining olefins from the intermediate stream, where ethylene refrigerant capacity is a bottleneck, comprising:

installing a solvent absorption/regeneration unit;

diverting at least a portion of the intermediate vapor stream to an absorption zone of the solvent absorption/regeneration unit;

wherein the diverted vapor is contacted with lean solvent to absorb olefins into the solvent to form a vapor product stream essentially free of olefins and an olefin-enriched solvent stream;

regenerating the olefins-enriched solvent stream in a regeneration zone of the solvent absorption/regeneration unit to form an olefins stream, essentially free of solvent and methane, and a lean solvent stream for recycle to the absorption unit;

feeding the olefins stream from the regeneration zone to an olefin fractionation unit.

* * * * *